United States Patent [19]

Landis

[11] 4,422,559

[45] Dec. 27, 1983

[54] MOLDED CONTAINER WITH SNAP-ON CLOSURE

[75] Inventor: H. Richard Landis, Oak Lawn, Ill.

[73] Assignee: Landis Plastics Inc., Chicago Ridge, Ill.

[21] Appl. No.: 330,710

[22] Filed: Dec. 14, 1981

[51] Int. Cl.[3] ..... B65D 41/16; B65D 41/18

[52] U.S. Cl. ..... 220/306; 220/69; 220/270; 220/380

[58] Field of Search ..... 220/306, 69, 270, 380

[56] References Cited

U.S. PATENT DOCUMENTS

| | | | |
|---|---|---|---|
| 3,498,268 | 3/1970 | Sheith et al. | 220/70 X |
| 3,811,597 | 5/1974 | Frankenburg | 220/306 |
| 3,926,324 | 12/1975 | Zarasnik | 220/70 X |
| 4,024,976 | 5/1977 | Acton | 220/306 X |
| 4,034,889 | 7/1977 | Hammes et al. | 220/306 |
| 4,190,175 | 2/1980 | Allen | 220/270 |

*Primary Examiner*—George T. Hall

*Attorney, Agent, or Firm*—Fitch, Even, Tabin & Flannery

[57] ABSTRACT

A plastic container and closure are provided which may be repeatedly snapped together. The closure has an outer skirt and an inner concentric flange providing a channel to receive a container rim. A plurality of ribs having lower edges extending inward from the inner flange and at depth to contact and cam the container rim toward the channel and prevent the container rim from catching on the closure flange during an automatic capping operation. A tear strip on the container sidewall is located adjacent the lower edge of the closure skirt thereby preventing access to the lower edge of the closure skirt without destructive removal of the tear strip. A radially outwardly extending strip at the lower end of the container spaces the outer surface of the container sidewall, which may bear a label, from any flat supporting surface when the container is laid on its side to prevent damage to the label.

8 Claims, 9 Drawing Figures

MOLDED CONTAINER WITH SNAP-ON CLOSURE

The present invention relates to molded plastic container assemblies and more particularly to containers with snap-on tops and means to prevent nondestructive opening of the container.

Flexible plastic containers have found widespread use in the food packaging industry, particularly for packaging food items. Such containers are inexpensively manufactured, provide secure sealing of the contents and are easily opened and resealed for storage of unused food.

Often tamperproof bands or seals are used because of the ease of opening and reclosing such containers would allow shoppers to open the container while on the shelf, sample the content and reseal a container in the absence of a tamperproof facility on the container. Various tamperproof constructions have been proposed such as that described in U.S. Pat. No. 4,024,976, in which a destructively removable band overlies the rim of the container cover, preventing the container from being pried open without obvious destruction of the protective band.

Although such devices have proven satisfactory in protecting the consumer, such protective devices have proven difficult to mold and add to the expense of the container. It would be desirable to have protective means which prevent non-destructive opening of containers that are of simpler design and easier and cheaper to produce.

Plastic containers are generally designed for ease of molding, and the shape of the outer surface is somewhat limited to shapes which may be formed along the surfaces of mold members and easily extracted therefrom. Accordingly plastic containers such as those formed of high density polyethylene commonly have smooth outer walls which will not interfere with their extraction from the mold. Because the containers are often labeled and thereafter rolled along a track of an assembly line for further processing, a flat outer surface allows the freshly applied label to touch the surface of the track as the container is rolled on its side. It would be desirable to have a container in which the surface to which the label is applied is elevated relative to a flat surface when the container is laid on its side and provide such feature in a container which is conveniently molded.

For most food packaging applications, it is necessary that a seal form between the container and the closure. As one method of providing a seal, the closure has an outer skirt and an inner skirt depending from the upper end wall providing a channel which receives the upper lip of the container. The channel is narrower than the lip, and the slight radial deformation of the skirts required for entrance of the lip achieves a sealing interfit of the lip within the channel.

After the container has been charged with product, the closure is applied thereto. Commonly used closing apparatus introduces the closure at an angle to the upstanding container whereby the lip of the container member catches the inner surface of the outer skirt, and the outer skirt overfits the lip beginning at one side. A difficulty occurs when the lip of the container catches the inner surface, not of the outer skirt, but of the inner skirt preventing a proper overfit of the outer skirt. When the container is subsequently passed under rollers, which firmly apply the closure to the container, the misapplied closure is crushed against the container resulting not only in the destruction of the container but frequency of the contents as well. It would be desirable to provide means to prevent the lip of the container from catching on the inner skirt.

It is an object of the invention to provide an improved tamperproof resealable molded container assembly which may be easily and inexpensively molded.

Another object of the invention is to provide an improved closure which may be readily applied by an automatic capping apparatus with assurance of proper closure and container alignment.

A still further object is to provide an improved container which provides for the spacing of the labeling surface from an assembly track surface when the container is laid on its side.

A container and a closure therefor are each molded as unitary pieces of plastic and have interfitting means whereby the closure may be securely snapped onto the container. The closure has an inner skirt concentric with its overfitting outer skirt for receiving the upper end or lip of the container therebetween and ribs extending radially from the inner skirt to prevent the accidental catching of the upper lip of the container on the inner skirt.

An easily molded, destructively removable flange, having a flat horizontal upper surface, is formed on the container closely adjacent its upper lip. The lower edge of the outer skirt extends to the flange when the closure is applied to the container, the flange blocking access of a prying means to the lower edge of the outer skirt without the removal of the flange.

An annular bead at the lower end of the container extends outward and spaces the labeling surface of the flat container above a flat surface when the container is laid on its side. The bottom wall of the container intersects with the lower skirt above the lower bead whereby the portion of the lower skirt extending below the junction flexes as the container is pulled from its mold freeing the upper surfaces of the bead from matching surfaces of the mold.

These and other objects and advantages of the invention will become more apparent from the following detailed description of the invention in reference to the accompanying drawings in which.

Figure 4:
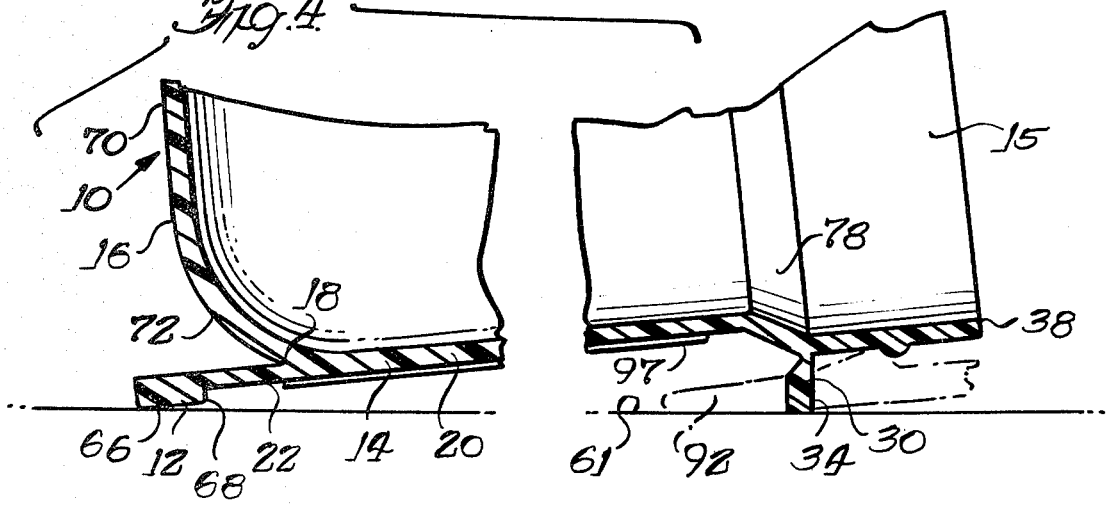
FIG. 4 is a partial cross-sectional view of the container laid on its side.

A container assembly 11 includes a container 10 and a snap-on closure 32 therefor. The container 10 has a circular bottom wall 16 and an upstanding cylindrical sidewall or skirt 20 having an upper lip 38 bounding an open upper end 15 (FIG. 4). The closure 32 has a top wall 19, which covers the open end 15 of the container 10, and a depending inner and outer skirt 42, 36 defining a groove 44 therebetween which receives the upper lip 38 of the upstanding container skirt 20. The groove 44 is slightly narrower than the thickness of the upper lip 38 whereby the inner and/or outer skirt 36, 42 flexes slightly during insertion of the upper edge in the groove 44 and forms a seal along at least one of the surfaces of the lip 38.

In accordance with the present invention, the resiliently flexible molded container 10 has means 12 on its lower end for spacing its outer cylindrical surface and exterior surface 14 above a flat surface 61 (FIG. 4) when the container 10 is laid on its side. More specifically, the preferred means 12 is in the form of an annular band or strip 66 of thickened cross section at the bottom of the cylindrical surface to form a larger diameter surface than the label receiving surface 67 thereabove. Usually, the container 10 is molded in one piece and it would be difficult to extract the container with the enlarged strip 66 from the mold. However, the container 10 is constructed so that it may be extracted from a mold without the strip 66 interfering with the withdrawal of the container from the mold. Sufficient flexibility is provided at the bottom wall 16 of the container 10 and its junction 18 with its upstanding skirt 20 above the strip 66 that the lower portion 22 of the skirt may flex radially inwardly as the container is stripped from the mold. If the bottom wall 16 were to continue in a straight plane to abut the cylindrical container wall at a substantially right angle intersection immediately above upper edge 68 of the strip, then the lower portion of the skirt 22 would be held against flexing and the container could not be stripped from the mold.

Also, according to an important aspect of this invention, a tamperproof tear strip 30 is provided on the container closely adjacent the lower edge of the closure's lower edge 40 to prevent gripping and peeling of the closure without first removing the tear strip 30. That is, the tear strip 30 prevents access by a prying instrument to the lower edge 40 of the overfitting skirt 36 unless one first removes the tear strip 30.

Figure 1:
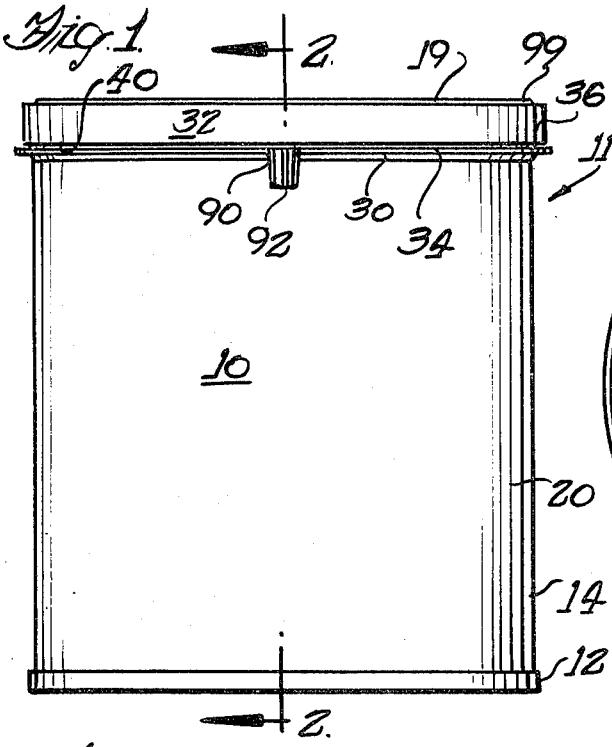
FIG. 1 is an elevation view of a container assembly embodying various features of the invention.
Figure 5:
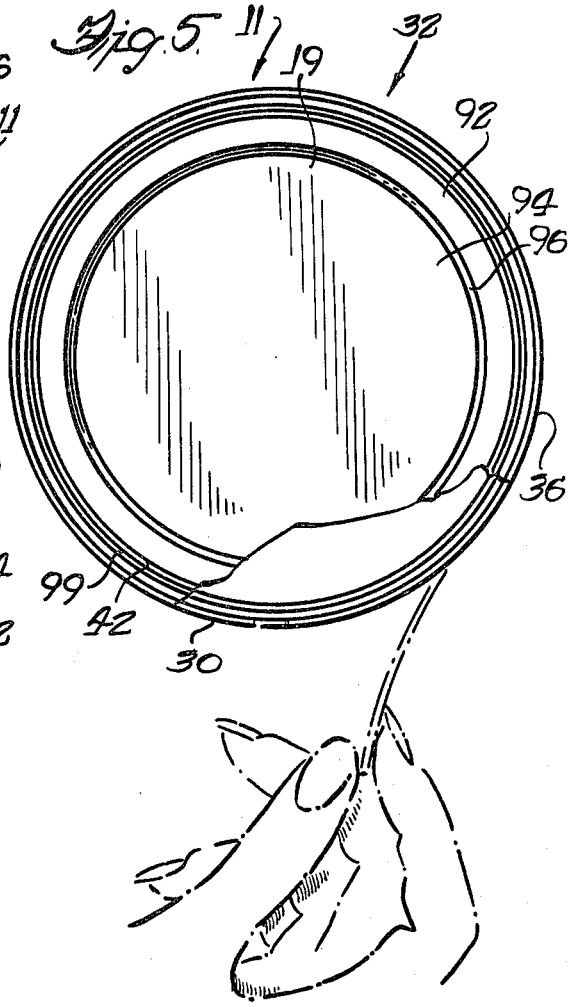
FIG. 5 is a plan view of the container assembly of FIG. 1.
Figure 2:
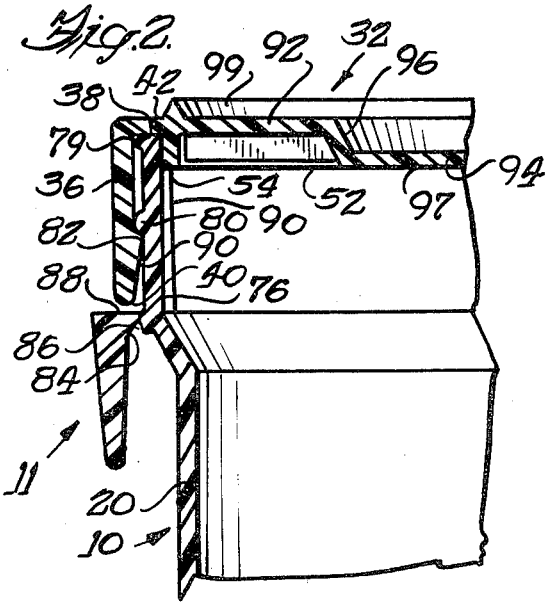
FIG. 2 is an enlarged partial cross-sectional view taken along line 2—2 of FIG. 1.
Figure 8:
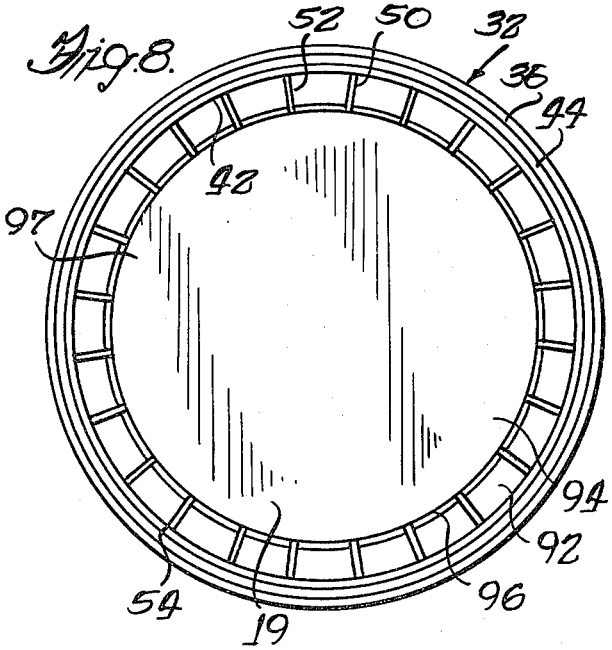
FIG. 8 is an under view of the closure of the container assembly.
Figure 8:
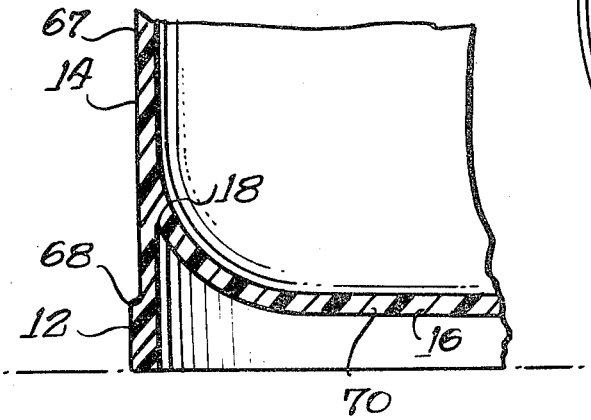
Figure 9:
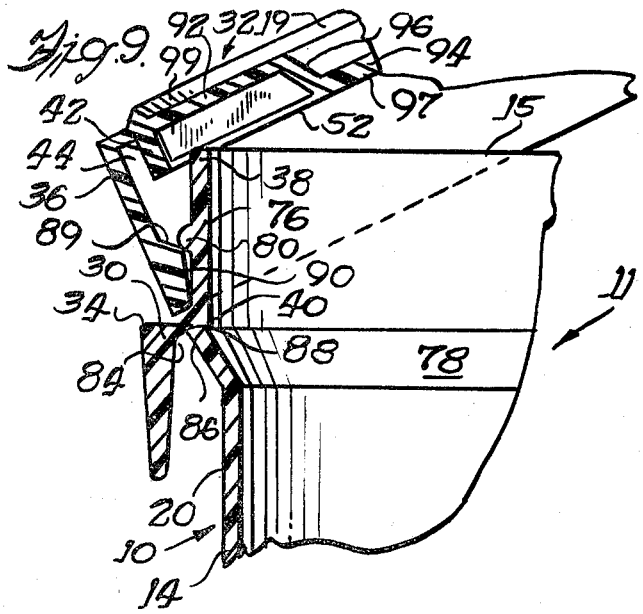
FIG. 9 is an enlarged partial cross-sectional view illustrating the closure being applied to the container at an angle.
Figure 6:
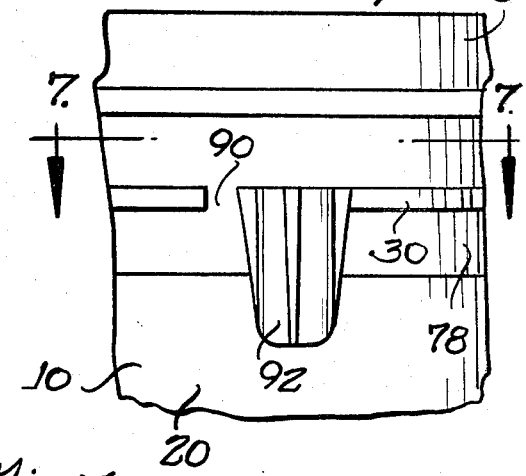
FIG. 6 is an enlarged partial elevation view of the closure and the protective flange of the container
Figure 7:
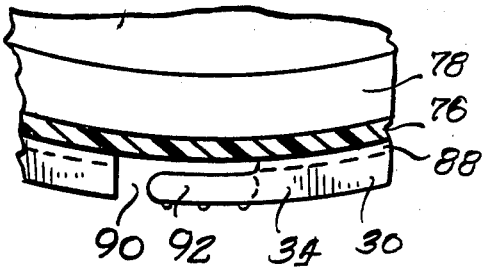
FIG. 7 is a cross-sectional view taken along line 7—7 of FIG. 6.

According to a further important feature of this invention, the closure 32 is constructed to facilitate its use without automatic capping machines which applies the closure 32 to a container rim or lip 38 at an angle as shown in FIG. 9. More specifically, the closure has an inner annular skirt wall 42 which would catch on the rim 38 and prevent its sliding into alignment with the adjacent rim receiving recess 44, that is, the lip 38 could catch on the inner surface 41 of the inner skirt 42 as may occur when the closure is applied at an angle (FIG. 9) as is commonly accomplished with conventional container closing apparatus. To prevent this catching, a series of ribs 52 are provided along the underside of the closure so that the container lip 38 will slide along the ribs and past the skirt 42.

Herein, the means for spacing the exterior surface 14 of the upstanding skirt 20 takes the form of an annular strip 66, projecting outwardly of the lower end of the upstanding skirt. The exterior or labeling surface 14 of the upstanding skirt 20 is sufficiently spaced from a flat surface 61 on which the container 10 lies that a newly applied label 97, which is typically a few thousandths of an inch thick does not touch the flat surface. The outer surface of the strip is cylindrical and the upper and lower ends 68 rounded.

The container and closure 10, 32 are molded as unitary pieces between molds appropriate to shape the interior and exterior surfaces thereof. The container and closure 20, 32 are formed of thermoplastics such as high density polyethylene which provide generally rigid assemblies that nevertheless have sufficient flexibility for achieving a snap fit.

Figure 3:
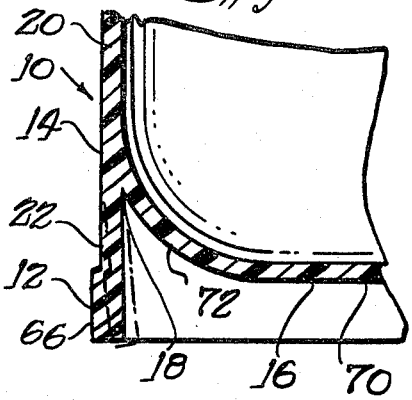
FIG. 3 is an enlarged partial cross-sectional view of the lower end of the container.

Referring now in greater detail to the illustrated invention, the spacing of the junction 18 of the bottom wall 16 and the upstanding skirt 20 upward from the spacing strip 66 and at a shallow angle to vertical of the junction, as contrasted to a sharp 90° angle, achieves the desired flexibility of the lower skirt portion 22 that allows the strip 66 to be extricated from the mold member. As best seen in FIG. 3, the bottom wall 16 of the container has a flat central portion 70 generally at the level of the top of the strip 66 and an edge portion 72 curving upward from the central portion 70 to the junction 18. The illustrated curved edge portion 72 of the bottom wall is at a radius of 0.250 inch which allows the flexing of the lower skirt portion 22 while adding substantially no additional height to the container to achieve the required volume. When the container 10 is pulled from the mold, that portion 22 of the upstanding skirt 20 below the junction 18 flexes inward (as shown in ghost in FIG. 3) allowing the rounded edge surface 68 of the strip 66 to be removed from interference with the corresponding surface of the mold. The desired spacing of the junction 18 above the upper end of the strip 66 and the angle of the intersection depend upon the flexibility of the material, the thickness of the upstanding skirt 20, the thickness of the annular bead and the diameter of the skirt.

The container's sidewall 20 in the illustrated embodiment is substantially cylindrical with a uniform diameter generally from its lower end toward its upper end, although containers according to the invention may be formed with frustoconical sidewalls which expand upward from their lower ends. In the illustrated container 10, an upper cylindrical portion 76 (FIG. 9) of greater diameter is joined to the lower portion of the upstanding skirt by a short frustoconical segment 78. The greater diameter portion 76 provides for the application of a greater diameter closure 32 having means for stacking container assemblies 11 as described in greater detail hereinafter. Preferably the lip 38 is enlarged to extend between the inner and outer skirts 42, 36 by an outwardly extending annular bead 79. The bead 79 extends to the outer skirt 36 providing an additional seal therewith.

The closure 32 is snap-fitted into locking engagement with the container 10. This locking is achieved when a rounded bead 80 of the exterior surface of the cylindrical upper portion 76 of the container is abutted on its underside by a locking bead 82 on the interior surface of the closure skirt 36. The closure locking bead 82 has an inner diameter less than the outer diameter of the container bead 80 and it is snapped thereover, usually with automated equipment. The lower surface 90 of the upper skirt bead 82 is chamfered at a small angle relative to the vertical and cams over the upstanding skirt bead 80 when the closure 32 is snapped onto the container 10. When the closure member 32 is applied to the container 10, a chamfered upper surface 89 on the closure bead 82 abuts the lower surface of the container bead 80 providing an interference fit.

The tear strip 30 is disposed below the rounded bead 80 generally at the junction of the container's frustoconical segment 78 and the upper portion 76. A flat horizontal upper surface 34 of the tear strip 30 is disposed closely adjacent the lower edge 40 of the outer skirt 36 of the closure 32 when the closure is applied. The tear strip is detachably connected at its upper end adjacent the junction of the upper portion 76 and the frustoconical portion 78. More specifically, a V-shaped groove 86 forms a line of weakness 88 which fractures as the tear strip is pulled. The flange 30 has a discontunuity 90 and a depending tab 92 which may be gripped by the fingers, at one end of the discontinuity. It is found that the tear strip 30 with a flat upper surface 34 will effectively prevent removal of a closure 32 without destructive removal of the strip if the lower closure skirt edge 40 is in close proximity to the upper surface of the tear strip within a very narrow tolerence that leaves insufficient room for a finger nail or other readily available prying means to be inserted between the lower edge 40 of the outer skirt and the strip 32. Accordingly the spacing between the top wall of the closure and the lower edge 40 of the outer skirt 36 is formed within close tolerances to be substantially equal to the distance between the upper surface 34 of the removal prevention strip 30 and the lip 38 of the upstanding skirt, and the interlocking beads 80, 82 are correspondingly disposed to hold the outer skirt closely adjacent tear strip. The latter extends radially outward to a greater diameter than the outer diameter closure skirt 36. While it might be possible for a shopper, with some effort, to wedge an instrument between the outer skirt 36 and the strip 30, such action would likely result in pealing the flange from the upstanding skirt 20, and the obvious destruction of the flange would serve notice to a customer that the container assembly had been opened. The strip 30 provided herein is much simpler to mold than prior art designs such as that described in U.S. Pat. No. 4,024,976 having an upwardly extending protective skirt, and thus containers as provided herein may be made more cheaply while maintaining the feature of preventing non-destructive closure removal.

In the illustrated closure 32, the top wall 19 of the closure 32 has an annular outer portion 92 from which the inner and outer skirts 42, 36 depend and a depressed central circular portion 94 joined thereto by an annular, generally vertical flange 96.

As previously explained, automatic closing equipment, of types in common use, introduce snap-on closures to corresponding containers at an angle (FIG. 9) whereby the outer skirt is applied over the upstanding skirt beginning at one point and continuing around on either side thereof. After the outer skirt 36 is fit over the upstanding skirt 20, the container 10 and closure 32 are passed under rollers which force the closure fully onto the container so that the outer closure bead 82 is located below the upstanding container bead 80 and the upper lip of the upstanding skirt is fully received in the groove 44 between the outer and inner skirt.

As explained above, the illustrated closure has a plurality of ribs 50 which have lower edges 52 which extend from the lower edge 53 of the inner skirt radially inward. The ribs 50 extend down to the lower surface of the depressed central portion 94 of the top wall 19. If the upper lip 38 of the upstanding skirt 20 initially contacts the closure 32 inward of the inner skirt 42, it slides and cams over the ribs 50 until at least a section thereof locates in the groove 44 between the inner and outer skirts 42, 36. When the aligned closure 32 is pressed by overhead rollers or the like firmly onto the container 10, the upper edge 38 of the container 10 is properly received to the groove 44. The overfit of the outer skirt 36, which begins at one point, continues around both sides thereof until the closure 32 is laid over the container 10 in proper alignment. Thus, the ribs 50 reduce waste which occurs when closures are misapplied and crushed in the subsequent rolling operation. The assurance of proper closure-container alignment also saves clean-up costs which arise when the improperly closed container 10 spills its contents along the processing line. In addition to assuring alignment of the closure 32 and container 10, the ribs 50 add to the strength and rigidity of the closure.

After the closure 32 is fully applied to the container 40 with the interfitting beads 80, 82 locking the closure to the container 10, the upper edge 38 of the upstanding skirt forms a seal with closure at a location between the inner and outer skirt 36 and 42 of the closure.

A label 97 (FIG. 4) may be glued to the cylindrical wall 14 of the container. The container assembly is turned on its side and rolled along a track for further processing, i.e., boxing of the sealed containers. The closed container assemblies roll along on the lower strip 66 and the upper tear strip 30, as seen in FIG. 4, with the label 97 spaced away from contact with the track surface 61.

The container assembly may be opened by gripping the tab 92 and pulling the frangible strip 30 from the upstanding skirt 20, and prying the upper closure 32 from the container 10. An intact frangible strip 30 is the customer's assurance that the container assembly 11 has not been previously opened. After the container assembly 11 is opened, it is easily resealed by manually pressing the closure 32 onto the container 10.

To assist in stacking closures and in stiffening the same, the upper sides of the closure may be formed with an annular ring 99 which extends upward from the upper surface of the outer portion 92 of the top wall 91. The ring has an interior diameter matched to the exterior diameter of the lower strip 66 of the container and receives the lower end of a container assembly stacked thereontop.

While the invention has been described in terms of a preferred embodiment, modifications obvious to one with ordinary skill in the art may be made without departing from the scope of the invention.

Various features of the invention are set forth in the following claims.

What is claimed is:

1. A molded container of plastic material comprising:

an upstanding substantially cylindrical sidewall on said container having an upper opening;

a lower portion of said container sidewall having a first predetermined diameter area for receiving indicia means thereon, lower rim means on said lower portion of said container defining a greater diameter than said indicia receiving area to space the latter from engagement with a surface when the container is turned on its side;

a bottom wall on said container integrally molded with and joined to said container side wall at a location above said lower rim means, an upwardly curved portion of the bottom wall extending upward to join the sidewall at an angle of substantially less than 90° said lower rim means being flexible so that the container may be molded as a unitary piece and pulled from the mold with said lower rim means flexing radially inward adjacent said upwardly curved portion as said molded container is pulled from the mold.

2. A container according to claim 1 wherein said rim means includes an annular strip that extends radially outward of the sidewall.

3. A container according to claim 1 having a tear strip connected to said container sidewall for separation therefrom.

4. A molded plastic closure for a container having a circular opening and a circular interlocking bead means, said closure comprising a circular top wall, an outer annular skirt depending from said top wall, a circular bead on said outer annular skirt facing radially inwardly to interlock with said circular bead means on the container when the closure is pressed downwardly on the container; an inner annular skirt depending from said top wall concentric with said outer skirt providing a channel between said skirts for receiving the upper rim of the container; stacking ring means on said upper circular wall of said closure;

an annular recess located in said top wall adjacent said inner skirt and extending radially inward;

a plurality of depending ribs integral with said closure and located in said recess with lower sides of the ribs extending closely adjacent a plane defined by the lower edge of said inner skirt so that the ribs will slide across the container rim to allow the rim to move into said channel and assist in snap fitting the closure onto a container with an interlocking of said closure bead and said container bead means with a downward force applied to the closure.

5. A container closure according to claim 4 wherein said top wall has a depressed central portion and said lower edges of said ribs extend to the lower surface of said depressed central portion.

6. A container closure according to claim 5 in which said ribs extending radially between said inner skirt and said depressed central portion are arranged in a circumferentially spaced array.

7. A plastic container assembly comprising:

a container having a bottom wall and an upstanding circular rim defining an upper opening;

a closure having a circular top wall, a depending outer annular skirt on said closure for circumferentially encompassing said container rim, an inner annular flange concentric with said skirt to define a channel therebetween for receiving said container rim;

interlocking bead means on container adjacent the rim, an interlocking circular bead on outer annular wall of the closure for being press downwardly past the container interlocking means to interlock therewith to hold the closure on the container;

stacking ring means on the upper top wall of the closure;

and a plurality of ribs having lower edges extending inward from the lower edge of said flange to closely adjacent said inner annular flange and defining a surface for camming said container rim past said flange and into said channel to interlock said bead and bead means when the closure is pressed down on the container.

8. A container assembly according to claim 7 wherein said upper wall has a depressed center portion and the lower edges of said ribs extend to the lower surface of said depressed center portion.

* * * * *